US009806460B2

(12) United States Patent
Li et al.

(10) Patent No.: US 9,806,460 B2
(45) Date of Patent: Oct. 31, 2017

(54) CARD EDGE CONNECTOR HAVING A COLLAPSIBLE EJECTOR

(71) Applicant: FOXCONN INTERCONNECT TECHNOLOGY LIMITED, Grand Cayman (KY)

(72) Inventors: Zhuang-Xing Li, Kunshan (CN); Wen-Jun Tang, Kunshan (CN); Xue-Wu Bu, Kunshan (CN); Hung-Chi Yu, New Taipei (TW); Qin Xu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/206,510

(22) Filed: Jul. 11, 2016

(65) Prior Publication Data

US 2017/0012389 A1 Jan. 12, 2017

(30) Foreign Application Priority Data

Jul. 10, 2015 (CN) ..... 2015 2 0495996 U

(51) Int. Cl.
*H01R 13/62* (2006.01)
*H01R 13/629* (2006.01)
*H01R 12/73* (2011.01)

(52) U.S. Cl.
CPC ..... *H01R 13/62955* (2013.01); *H01R 12/737* (2013.01)

(58) Field of Classification Search
CPC ..... H01R 13/62955; H01R 13/62988; H01R 13/635; H01R 13/6335
USPC ..... 439/157, 159, 160
See application file for complete search history.

(56) References Cited

U.S. PATENT DOCUMENTS 6,000,958 A * 12/1999 Ishida ..... G06K 13/08 439/159
6,146,164 A * 11/2000 Tung ..... G06K 13/0806 439/159
6,176,714 B1 * 1/2001 Ishida ..... G06K 13/08 439/159
8,235,740 B2 * 8/2012 Tsai ..... H01R 12/7029 439/328

(Continued)

FOREIGN PATENT DOCUMENTS

TW M472334 U 2/2014

*Primary Examiner* — Dac D Ta
*Assistant Examiner* — Thang Nguyen
(74) *Attorney, Agent, or Firm* — Wei Te Chung; Ming Chieh Chang

(57) ABSTRACT

A card edge connector includes an elongated insulative housing extending in a longitudinal direction and defining at least one tower portion extending upwardly from a longitudinal end thereof, a plurality of contacts retained in the insulative housing, and an ejector received in the at least one tower portion for latching with or ejecting a memory card. The ejector has a base portion rotatably attached to the tower portion and a locking portion rotatably attached to the base portion, the at least one tower portion has a slot, the locking portion is rotatable inward to face towards the top surface of the insulative housing in order to reduce a height of the card edge connector, the base portion has a lower ejecting section, and the locking portion has an upper locking section.

16 Claims, 7 Drawing Sheets

(56) References Cited

U.S. PATENT DOCUMENTS

| | | | | |
|---|---|---|---|---|
| 8,636,528 | B2 * | 1/2014 | Sass | H01R 12/7029 439/157 |
| 2003/0073332 | A1 * | 4/2003 | Bu | H01R 12/721 439/159 |
| 2008/0026618 | A1 * | 1/2008 | Mon | H01R 13/62988 439/159 |
| 2009/0077293 | A1 * | 3/2009 | Kerrigan | H05K 7/1409 710/301 |
| 2012/0164859 | A1 * | 6/2012 | Li | H01R 12/721 439/153 |
| 2013/0109216 | A1 * | 5/2013 | Chien | H01R 12/7005 439/345 |
| 2014/0199866 | A1 * | 7/2014 | Tang | H01R 12/7094 439/159 |
| 2014/0213085 | A1 * | 7/2014 | Yao | H01R 43/26 439/159 |

* cited by examiner

CARD EDGE CONNECTOR HAVING A COLLAPSIBLE EJECTOR

BACKGROUND OF THE INVENTION

1. Field of the Invention

The present invention relates to a card edge connector, and more particularly to a reduced height card edge connector having a collapsible ejector.

2. Description of the Related Art

Taiwan Pat. No. M472334, issued on Feb. 11, 2014, discloses a reduced height card edge connector which includes an insulative housing extending in a longitudinal direction and a plurality of contacts received in the insulative housing. The insulative housing defines a central slot for inserting a memory card and a pair of tower portions for receiving a pair of ejectors. The tower portion defines a cavity and the ejector is rotatably attached to the cavity. A preventing portion is formed in the cavity. The ejector includes a main portion, an upper locking section, and a lower ejecting section. The ejector defines a hole running through opposite sides of the main portion in the longitudinal direction to be capable of folding inwardly down to achieve a height of the connector.

However, the hole provided on the main portion of the ejector weakens the strength of the ejector structurally.

Therefore, an improved card edge connector is desired to overcome the disadvantages of the related arts.

SUMMARY OF THE INVENTION

An object of the present invention is to provide a card edge connector having an high strength ejector.

In order to achieve above-mentioned object, a card edge connector includes an elongated insulative housing extending in a longitudinal direction, a plurality of contacts retained in the insulative housing, and an ejector rotatably attached to the insulative housing. The insulative housing defines a top surface, an elongated passageway recessing downwardly from the top surface, and at least one tower portion extending upwardly from a longitudinal end thereof The plurality of contacts retained in the insulative housing in two rows along two sides of the passageway and the ejector received in the at least one tower portion for latching with or ejecting the memory card. The ejector has a base portion rotatably attached to the tower portion and a locking portion rotatably attached to the base portion, the at least one tower portion has a slot, the locking portion is rotatable inward to face towards the top surface of the insulative housing, the base portion has a lower ejecting section, and the locking portion has an upper locking section.

Other objects, advantages and novel features of the invention will become more apparent from the following detailed description of the present embodiment when taken in conjunction with the accompanying drawings.

DETAILED DESCRIPTION OF THE INVENTION

Figure 1:
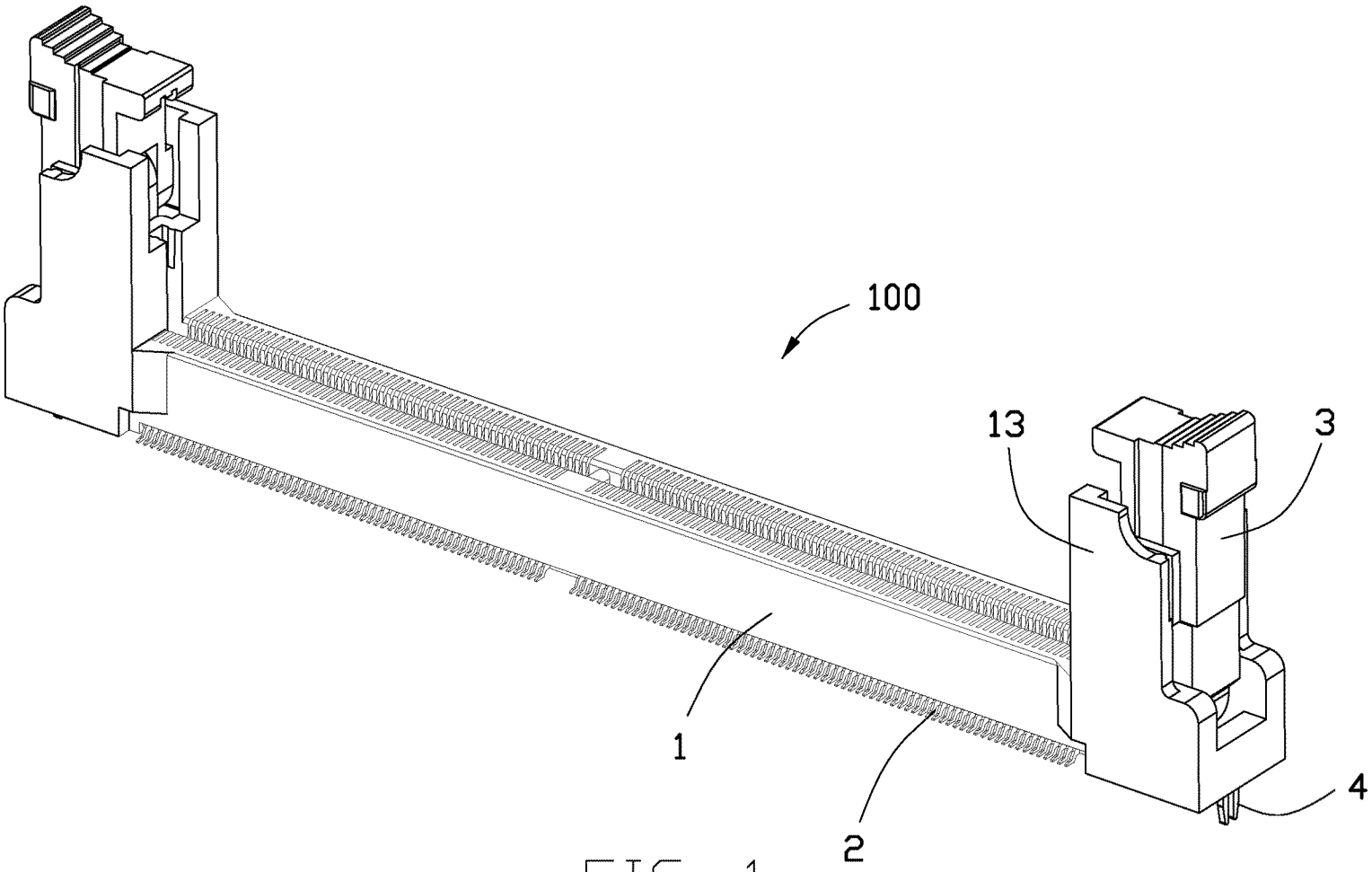
FIG. 1 is a perspective view of a card edge connector in accordance with the preferred embodiment of the present invention.

Reference will now be made to the drawing figures to describe the preferred embodiments of the present invention in detail.

Figure 2:
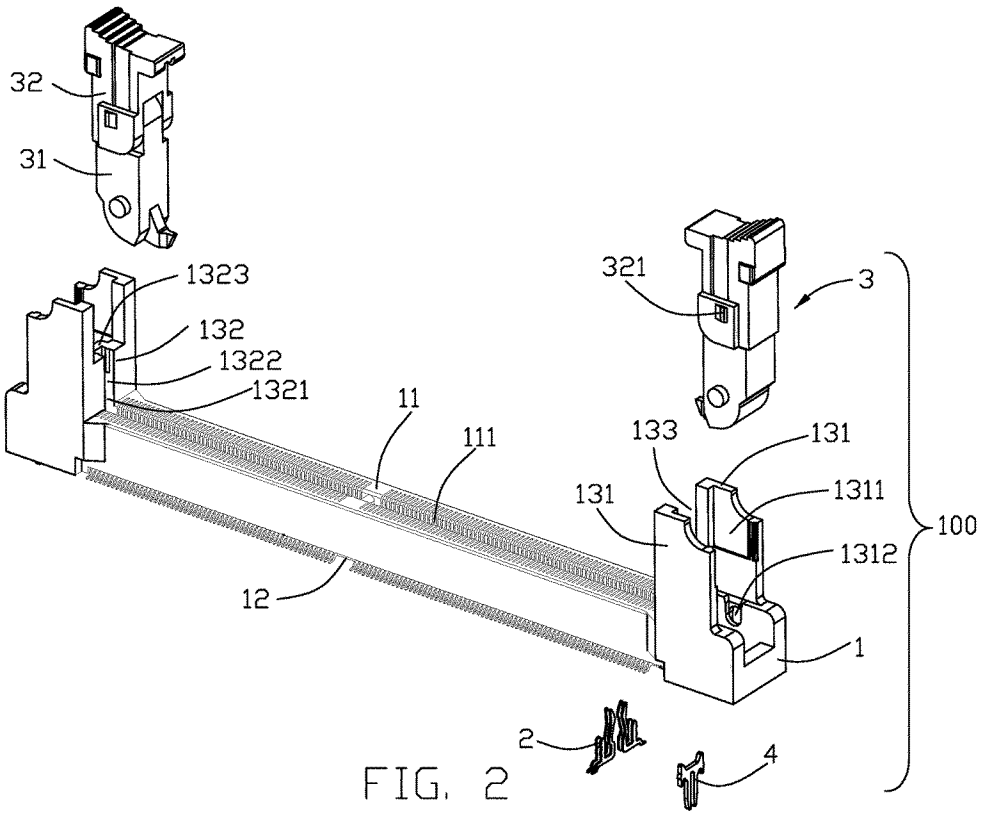
FIG. 2 is a partly exploded perspective view of the card edge connector of FIG. 1.

Referring to FIGS. 1 and 2, a card edge connector 100 is adapted to be mounted on a printed circuit board (PCB) (not shown) and then engage with a memory card/module (not shown) for interconnecting between both thereof The card edge connector 100 includes elongated insulative housing 1 extending in a longitudinal direction, a plurality of contacts 2 are retained in the longitudinal insulative housing 1, a pair of ejectors 3 pivoted in opposite longitudinal ends of the insulative housing 1 for latching with or ejecting the memory card (no shown), and a board lock 4 retained in the insulative housing 1.

Figure 3:
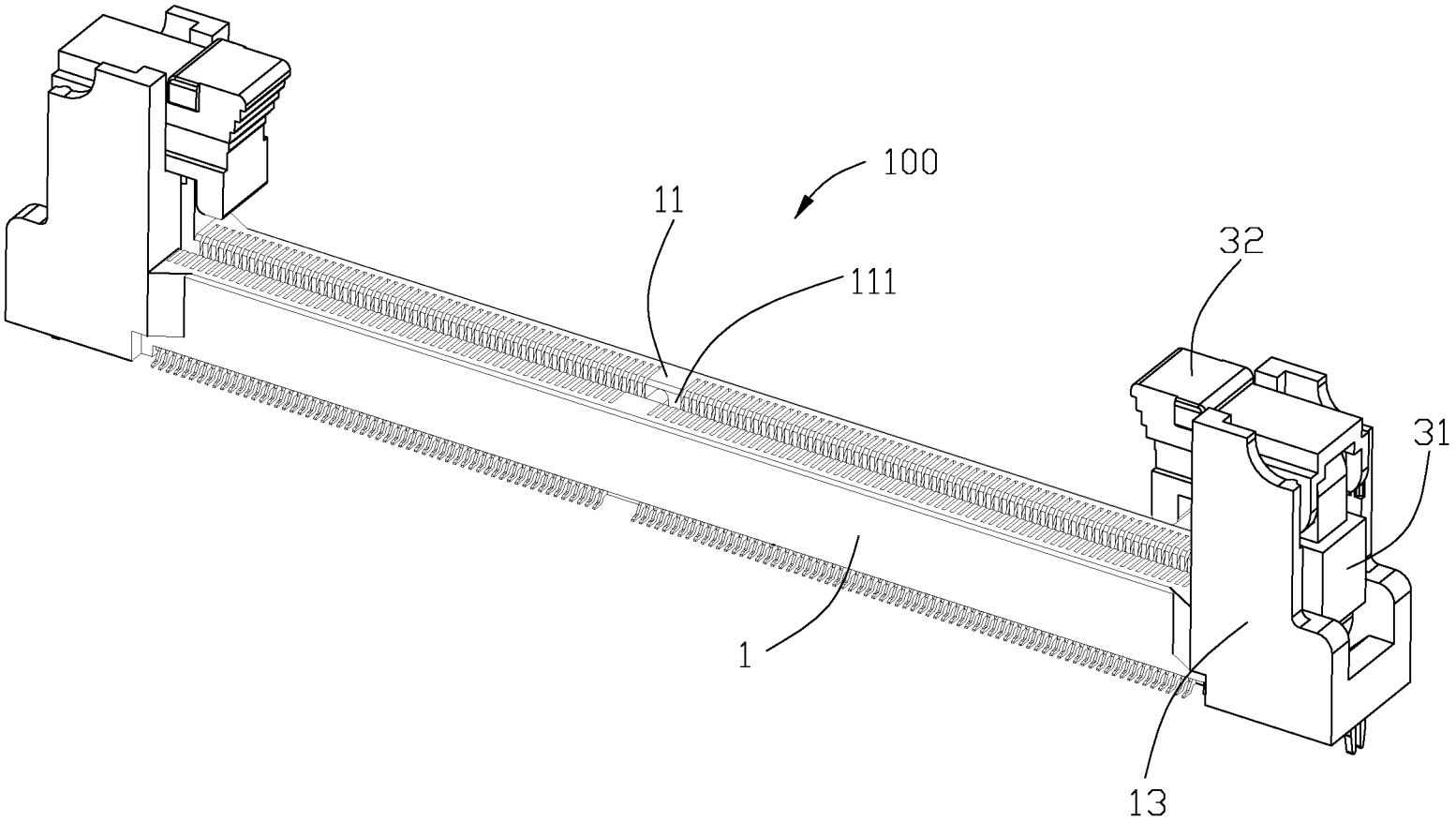
FIG. 3 is another perspective view of the card edge connector with the ejector lying down inward shown in FIG. 1.
Figure 4:
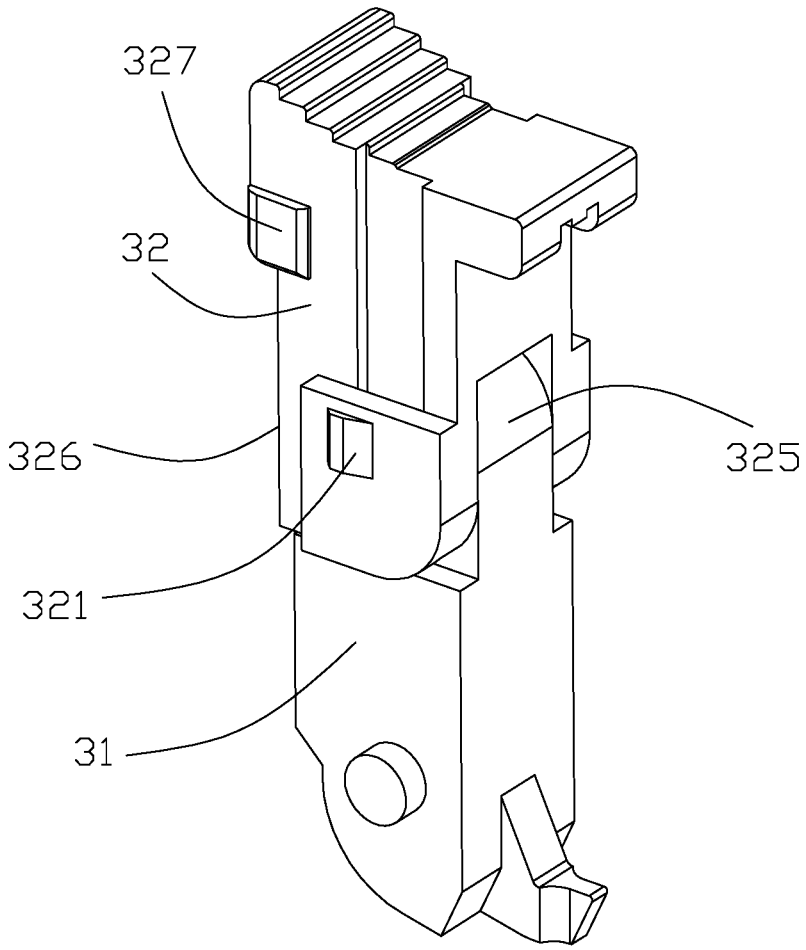
FIG. 4 is an enlarged perspective view of an ejector of the card edge connector shown in FIG. 1.

Referring to FIGS. 3 and 4, the insulative housing 1 defines a top surface 11 and a bottom surface 12 opposite to the top surface 11, the insulative housing 1 defines an elongated passageway 111 recessed from the top surface 11 for insertion of the memory card (no shown), the plurality of contacts 2 retained in the insulative housing in two rows along two sides of the passageway 111. The board lock 4 is mounted onto the bottom surface 12 of the insulative housing 1. The insulative housing 1 includes a pair of tower portions 13 extended upwardly from opposite longitudinal ends in the longitudinal direction, in order to reduce the whole height of the card edge connector 100, the ejector 3 includes a base portion 31 rotatably attached to the tower portion 13 and a locking portion 32 rotatably attached to the base portion 31. When an inward force is applied to the locking portion 32, the locking portion 32 will rotate inward in the longitudinal direction and then face towards the top surface 11 of the insulative housing 1. The tower portion 13 includes a pair of side walls 131 formed on opposite sides thereof in a lateral direction perpendicular to the longitudinal direction and a lower middle wall 132 located between two side walls 131 extending from the top surface 11 of the insulative housing 1. The height of the lower middle wall 132 is lower than the side wall 131, an upper end of the lower middle wall 132 and the two side walls 131 jointly formed a slot 133 for passing through the locking portion 32.

Specifically, the locking portion 32 has a pair of preventing lugs 321 formed on opposite sides thereof in a lateral direction, and each side wall 131 of the tower portion 13 includes a groove 1311 for cooperating with the preventing lug 321 to allow a movement of the lug 321 in the groove when the locking portion is pressed by a user while limiting the locking portion 32 from further opening outward to disengage from the tower portion 13. In order to better limit the memory card in the passageway 111, the lower middle wall 132 includes a notch 1321 communicating with the passageway 111, the notch 1321 has a pair of retaining walls 1322 for retaining the memory card (not shown) in the lateral direction and a limiting wall 1323 located between the two retaining walls 1322 for limiting the memory card (not shown) in the longitudinal direction.

Figure 5:
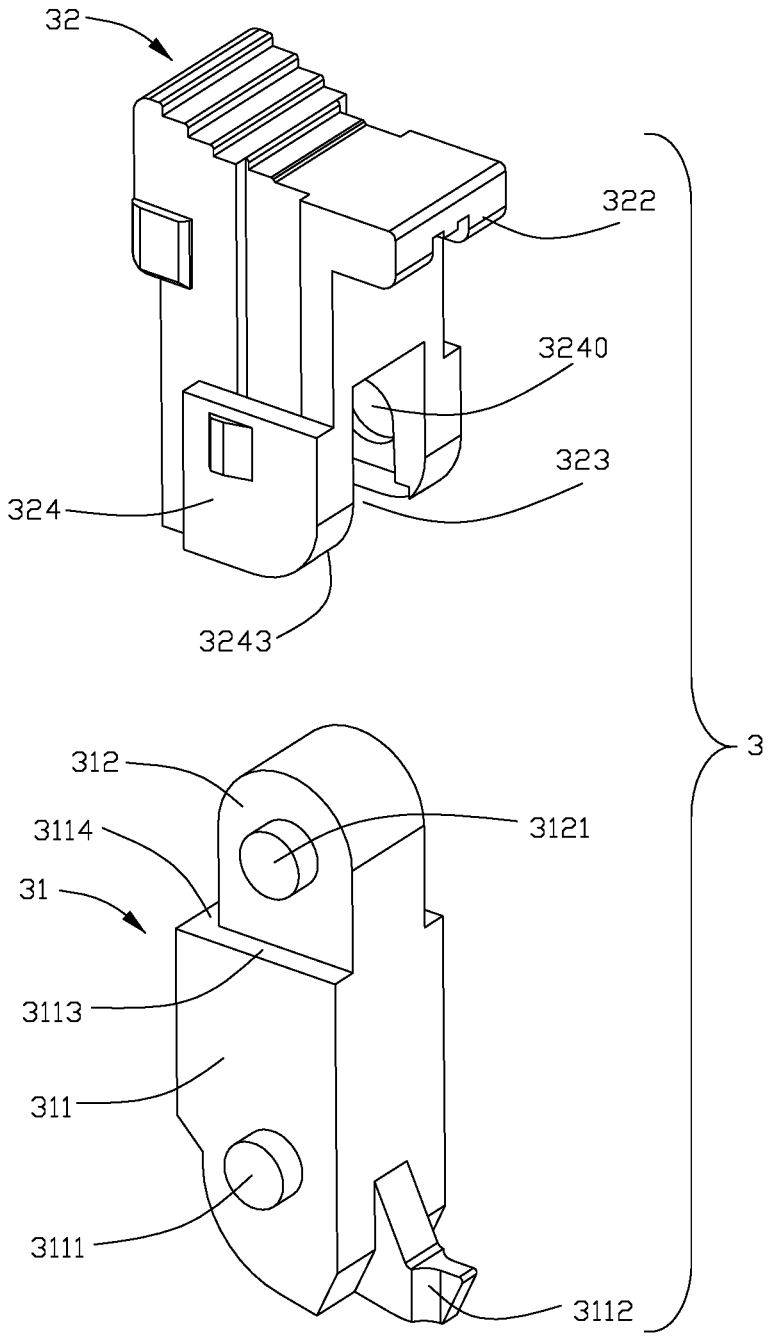
FIG. 5 is a partly exploded perspective view of the ejector of FIG. 4.
Figure 6A:
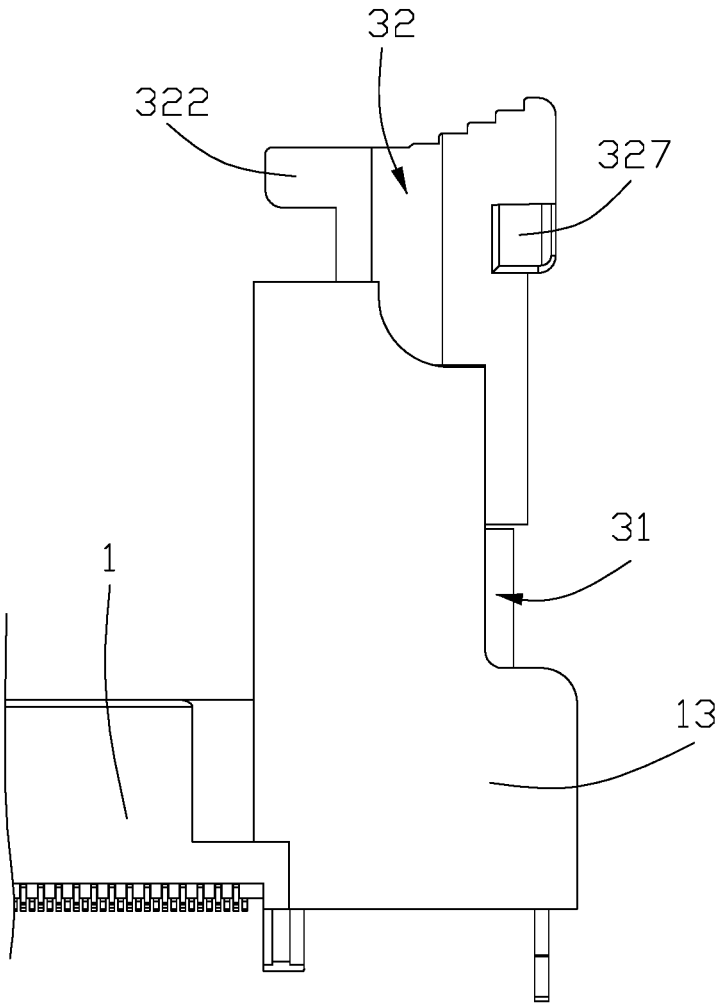
FIG. 6(A) is a partial cross-sectional view of the card edge connector of FIG. 1 when the ejector is in an unfolded/upstanding manner.
Figure 6B:
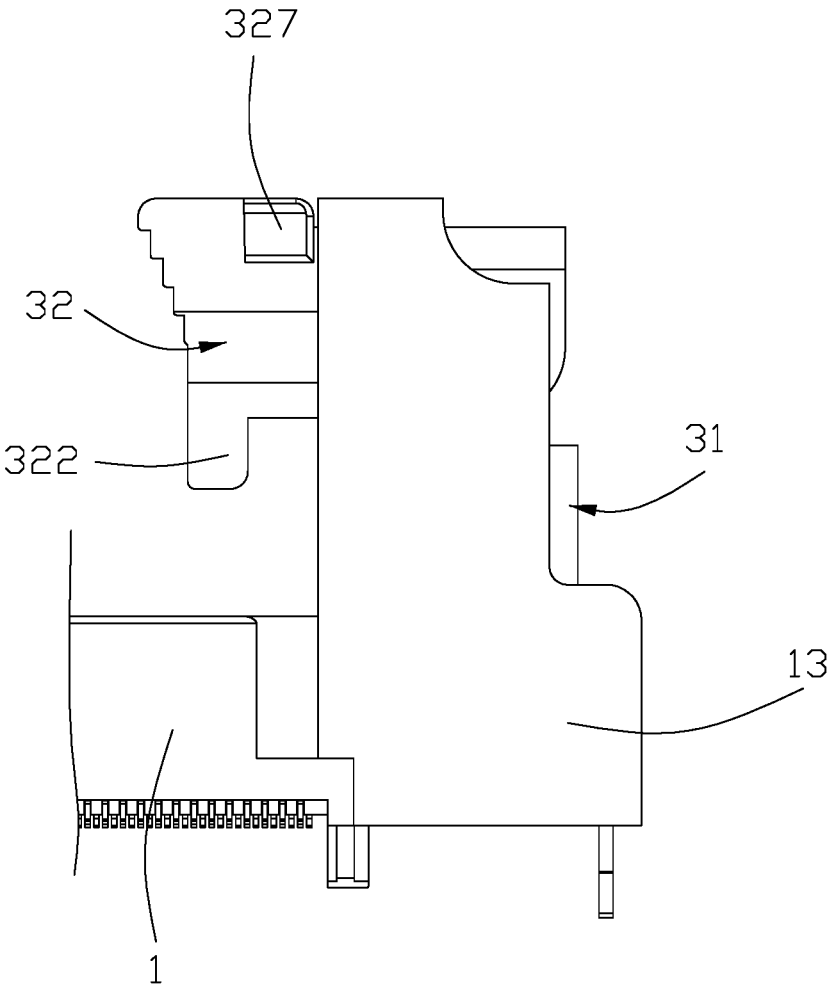
FIG. 6(B) is a partial cross-sectional view of the card edge connector of FIG. 1 when the ejector is in a folded manner

Referring to FIG. 5-6(B), the base portion 31 has a body section 311 and a connecting section 312 extended upwardly from an upper surface of the body section 311, the locking portion 32 cooperates with the connecting section 312. Each side wall 131 of the tower portion 13 includes a pivoting slot 1312, the body section 311 has a pair of pivots 3111 rotatably received in the corresponding pivoting slot 1312 and a lower ejecting section 3112 extended from a lower end thereof The locking portion 32 rotatably attached to the connecting section 312, the locking portion 32 includes an upper locking section 322 extended from an upper end thereof and a receiving cavity 323 formed on a lower surface thereof The receiving cavity 323 defines a first preventing wall 326, and two second preventing walls 324 formed at opposite sides of the first preventing wall 326, an opening 325 opposite to the first preventing wall 326 and located adjacent to the lower middle wall 132, the opening is used for rotating the locking portion 32 inward around the connection section 312. Each second preventing wall 324 defines a second pivoting slot 3240, and the connecting portion 312 defines a pair of second pivots 3121 rotatably received in the corresponding second pivoting slots 3240.

The upper surface of the body section 311 includes a pair of first stopping surfaces 3113 formed at the opposite sides of the connecting section 312 in the lateral direction and a second stopping surface 3114 formed at an outer side of the connecting section 312 away from the lower middle wall 132 in the longitudinal direction, a bottom end of the first preventing wall 326 and second preventing wall 324 abuts on the second stopping surface 3114 and first stopping surface 3113 respectively. Further, the bottom end of the second preventing wall 324 includes an avoiding rounded corner 3243 adjacent to the lower middle wall 132, the avoiding rounded corner 3243 is used for avoiding the first stopping surfaces 3113 when the locking portion 32 rotating inward. In order to rotate inward the locking portion 32 with a 90 degree, the pair of first stopping surfaces 3113 and the lower middle wall 132 defines a same height. The card edge connector 100 has a low height when the locking portion 32 rotated inward.

From a technical viewpoint, because the body portion 31 stands still when the ejector 3 is in a folded state by inwardly rotating the locking portion 32, the lower middle wall 132 stands upwards without being bothered by the ejector 3, thus avoiding any interference situation thereof On the other hand, the locking portion 32 is kept in the horizontal position by engagement between the bosses 327 and the side walls 131.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed. For example, in an alternate embodiment the upper locking portion 32 may further moveable relative to the lower base portion 31 in the vertical direction when the ejector 3 is in an unfolded state between upper and lower positions, wherein when the upper locking portion 32 is in the lower position with regard to the lower base portion, the upper locking portion 32 is essentially secured to the lower base portion 31 without any relative rotation but when the upper locking portion 32 is in an upper position with regard to the lower base portion 31, the upper locking portion 32 is able to be inwardly rotated to be moved to the lying position. This alternate arrangement may provide the more user-friendly operation compared with the embodiment shown here.

What is claimed is:

1. A card edge connector for engaging with a memory card, comprising:

an elongated insulative housing extending in a longitudinal direction and defining a top surface, an elongated passageway recessing downwardly from the top surface, and at least one tower portion extending upwardly from a longitudinal end thereof;

a plurality of contacts retained in the insulative housing in two rows along two sides of the passageway; and an ejector received in the at least one tower portion for latching with or ejecting the memory card; wherein the ejector has a base portion rotatably attached to the tower portion and a locking portion rotatably attached to the base portion, the at least one tower portion has a slot, the locking portion is rotatable inward through the slot to face towards the top surface of the insulative housing, and the base portion has a lower ejecting section, the locking portion has an upper locking section;

the base portion has a body section and a connecting section extending upwardly from the body section for engaging the locking portion; and the locking portion has a receiving cavity at a lower surface thereof and a pair of second pivoting slots at opposite sides of the receiving cavity, and the connecting section has a pair of second pivots rotatably received in corresponding second pivoting slots.

2. The card edge connector as described in claim 1, wherein the locking portion has a pair of preventing lugs formed on opposite sides thereof in a lateral direction perpendicular to the longitudinal direction, and the tower portion has a pair of side walls each including a groove cooperating with the preventing lug.

3. The card edge connector as described in claim 1, wherein the tower portion has a lower middle wall formed at the top surface of the insulative housing and connecting the two side walls, the lower middle wall has an upper end lower than the side wall, and the slot is located at the lower middle wall.

4. The card edge connector as described in claim 3, wherein the lower middle wall includes a notch, the notch has a pair of retaining walls for retaining a memory card and a limiting wall located between the two retaining walls for limiting a movement of the memory card in the passageway along the longitudinal direction.

5. The card edge connector as described in claim 4, wherein the tower portion has a pair of pivoting slots at two side walls thereof, and the body section has a pair of pivots rotatably received in the pivoting slots.

6. The card edge connector as described in claim 5, wherein the receiving cavity has an opening adjacent to the lower middle wall and a first preventing wall opposite to the opening, the first preventing wall being designed for stopping the locking portion from rotating outward.

7. The card edge connector as described in claim 6, wherein the upper surface of body section has a pair of first stopping surfaces formed at the opposite sides of the connecting section in the longitudinal direction and a second stopping surface on an outer side of the connecting section away from the lower middle wall in the lateral direction, the receiving cavity has a pair of second preventing walls on opposite sides of the first preventing wall, the first preventing wall abuts on the second stopping surface, and the pair of second preventing walls abut on the pair of first stopping surfaces.

8. The card edge connector as described in claim 7, wherein the second preventing wall has a rounded corner at a bottom surface thereof adjacent to the lower middle wall.

9. The card edge connector as described in claim 8, wherein the pair of first stopping surfaces and the lower middle wall has a same height.

10. A card edge connector for use with a memory module, comprising:

an insulative housing defining an insulative elongated housing along a longitudinal direction with a receiving slot therein for receiving the memory module, a pair of towers located at two opposite ends of the housing in said longitudinal direction, each of said towers defining a lower middle wall and a pair of side walls;

a plurality of contacts disposed by two sides of the receiving slot along said longitudinal direction;

at least one ejector pivotally disposed in one of said towers, said ejector including a lower base portion and an upper locking portion pivotally mounted upon the lower base portion, a pair of pivots formed upon the lower base portion so as to allow said ejector to be pivotal with regard to the tower; wherein the lower base portion includes a lower ejecting section for ejecting the daughter module, and said upper locking portion includes an upper locking section for locking the module module; wherein generally, said ejector is located in an upstanding/unfolded state in which both said lower base portion and said upper locking portion stand upwardly so as to be adapted to be outwardly rotated away from the receiving slot in said longitudinal direction, and is adapted to be in a folded state in which the upper locking portion is inwardly rotated toward the receiving slot and moved to a lying position for lowering a height thereof while the lower base portion still upwardly stands; and said upper locking portion forms a receiving cavity to receive an upper region of the lower base portion, and a preventing wall formed on an outer side of the receiving cavity to prevent the upper locking portion from being outwardly rotated with regard to the lower base portion, and an opening formed in an inner side of the receiving cavity and opposite to the preventing wall to allow the upper locking portion to be inwardly rotated toward the receiving slot relative to the lower base portion so as to have the ejector in said folded state.

11. The card edge connector as claimed in claim 10, wherein said lower base portion and said upper locking portion are pivotally assembled to each other about a pivot which is located at an upper region of the lower base portion and a lower region of the upper locking portion.

12. The card edge connector as claimed in claim 10, wherein said upper locking portion includes a lug for engagement with a corresponding side wall to keep the ejector in an upstanding position, and a boss for engagement with the middle wall to keep the upper locking portion in a horizontal position when the ejector is in a folded state.

13. The card edge connector as claimed in claim 10, wherein said pair of side walls are dimensioned with a height similar to the ejector when the ejector is in the folded state.

14. An ejector for use with a card edge connector which includes an insulative housing with an elongated receiving slot for receiving a memory module, and a pair of towers at two opposite ends along a longitudinal direction wherein said ejector is pivotally located in one of said tower, said ejector comprising:

a lower base portion on which a pivot is formed for pivotally mounting to the tower, and a lower ejecting section for ejecting the memory module; and an upper locking portion pivotally mounted upon the lower base portion, on which an upper locking section is formed for locking the memory module; wherein a pivot between said lower base portion and said upper locking portion is located around a lower region of the upper locking portion and an upper region of the lower base portion, and through said pivot the ejector can be in either an unfolded state where the upper locking portion and the lower base portion are both in an upstanding manner, or a folded state where the upper locking portion is angled with the lower base portion; and said upper locking portion forms a receiving cavity to receive an upper region of the lower base portion with an opening being located in an inner side of the receiving cavity for allowing the upper locking portion to be inwardly rotated with regard to the lower base portion when said ejector is in the folded state, and a preventing wall being located on an outer side of the receiving cavity for preventing the upper locking portion from being outwardly rotated with respect to the lower base portion when the ejector is in the folded state.

15. The ejector as claimed in claim 14, wherein said upper locking portion further includes a lug for preventing disengagement of the ejector from the housing when said ejector is in the unfolded state, and a boss for retaining the upper locking portion with regard to the housing when said ejector is in the folded state.

16. The ejector as claimed in claim 14, wherein the upper locking portion lies in a horizontal position with a right angle with regard to the lower base portion when said ejector is in the folded state.

* * * * *